US005944955A

United States Patent [19]

Bossen et al.

[11] Patent Number: 5,944,955

[45] Date of Patent: Aug. 31, 1999

[54] FAST BASIS WEIGHT CONTROL FOR PAPERMAKING MACHINE

[75] Inventors: David A. Bossen, Palo Alto, Calif.; E. Michael Heaven, North Vancouver, Canada; John D. Goss, San Jose, Calif.

[73] Assignee: Honeywell-Measurex Corporation, Cupertino, Calif.

[21] Appl. No.: 09/007,733

[22] Filed: Jan. 15, 1998

[51] Int. Cl.[6] ..... D21F 1/06; D21F 1/08; D21F 7/00

[52] U.S. Cl. ..... 162/198; 162/252; 162/253; 162/258; 162/259; 162/DIG. 6; 162/DIG. 11

[58] Field of Search ..... 162/258, 259, 162/DIG. 11, DIG. 10, 336, 337, 253, 198, 252, 263, 264, 262; 364/471.01, 471.02, 471.03

[56] References Cited

U.S. PATENT DOCUMENTS

| | | | |
|---|---|---|---|
| 3,206,642 | 9/1965 | Canter et al. . | |
| 3,552,203 | 1/1971 | Freeh | 162/DIG. 11 |
| 3,593,128 | 7/1971 | Perry . | |
| 3,619,360 | 11/1971 | Persik, Jr. | 162/258 |
| 3,630,836 | 12/1971 | Bietry et al. . | |
| 3,636,327 | 1/1972 | Troutman . | |
| 3,646,434 | 2/1972 | Norwich . | |
| 3,649,444 | 3/1972 | Futch | 162/DIG. 11 |
| 3,654,075 | 4/1972 | Keyes et al. . | |
| 3,713,966 | 1/1973 | Lippke . | |
| 3,723,712 | 3/1973 | Komline, Sr. et al. . | |
| 3,723,865 | 3/1973 | Batey et al. . | |
| 3,795,984 | 3/1974 | Meyer . | |
| 3,811,087 | 5/1974 | Schmelzer . | |
| 3,852,578 | 12/1974 | Rice | 364/150 |
| 3,864,626 | 2/1975 | MacLean et al. . | |
| 3,909,380 | 9/1975 | Day et al. . | |
| 3,986,110 | 10/1976 | Overall et al. . | |
| 4,135,151 | 1/1979 | Rogers et al. . | |
| 4,259,632 | 3/1981 | Ahtiainen . | |
| 4,314,878 | 2/1982 | Lee . | |
| 4,329,201 | 5/1982 | Bolton . | |
| 4,369,080 | 1/1983 | Johnson . | |
| 4,398,996 | 8/1983 | Bolton et al. . | |
| 4,468,611 | 8/1984 | Tward . | |
| 4,474,643 | 10/1984 | Lindblad . | |
| 4,514,812 | 4/1985 | Miller et al. . | |
| 4,535,285 | 8/1985 | Evans et al. . | |
| 4,580,233 | 4/1986 | Parker et al. . | |
| 4,588,943 | 5/1986 | Hirth . | |
| 4,613,406 | 9/1986 | Gess . | |
| 4,648,715 | 3/1987 | Ford, Jr. et al. . | |
| 4,680,089 | 7/1987 | Aral et al. . | |
| 4,692,616 | 9/1987 | Hegland et al. . | |
| 4,707,779 | 11/1987 | Hu . | |

(List continued on next page.)

FOREIGN PATENT DOCUMENTS

| | | |
|---|---|---|
| 0276106 | 7/1988 | European Pat. Off. . |

OTHER PUBLICATIONS

Smook, G.A., Handbook for Pulp & Paper Technologist, 2d. ed., (Angus Wilde Publications), 1992, pp. 228–229.

*Primary Examiner*—Peter Chin
*Assistant Examiner*—Kevin Cronin
*Attorney, Agent, or Firm*—Burns, Doane, Swecker & Mathis LLP

[57] ABSTRACT

Apparatus and process for controlling the basis weight of paper produced in a papermaking machine are provided. In the papermaking process, a major portion of the paper stock flows through a first line that is controlled by a thick stock valve and a minor portion of the stock flow from the stuff box to the headbox is diverted through a second line that is regulated by a second valve (e.g., vernier valve). The thick stock valve is controlled by the dry end basis weight and the second valve responsive to measurements of the basis weight of the wet stock at the wire. The second line and control valve along with the wet end basis weight measurements form a fine control loop with fast response time whereas the first line and control valve that is responsive to dry end basis weight measurements form a course control loop. The dual control loops enable fast and actual basis weight control.

40 Claims, 7 Drawing Sheets

U.S. PATENT DOCUMENTS 4,748,400 5/1988 Typpo .
4,786,529 11/1988 Boissevain .
4,791,353 12/1988 Typpo .
4,817,021 3/1989 Sowerby et al. .
4,827,121 5/1989 Vidrine, Jr. et al. .
4,840,706 6/1989 Campbell .
4,845,421 7/1989 Howarth et al. .
4,903,528 2/1990 Balakrishnan et al. .
4,909,070 2/1990 Smith .
4,921,574 5/1990 Hu .
4,924,172 5/1990 Homgren .
4,947,684 8/1990 Balakrishnan .
4,957,770 9/1990 Howarth .
4,980,846 12/1990 Chapman .
4,986,410 1/1991 Shields .
4,990,261 2/1991 Ho .
4,994,145 2/1991 Seymour .
5,013,403 5/1991 Chase .
5,020,469 6/1991 Boissevain et al. .
5,021,740 6/1991 Sarr et al. .
5,022,966 6/1991 Hu .
5,045,798 9/1991 Hendrick .
5,052,223 10/1991 Regnault et al. .
5,067,345 11/1991 Mougne .
5,093,795 3/1992 Lewis .
5,122,754 6/1992 Gotaas .
5,124,552 6/1992 Anderson .
5,132,631 7/1992 Klopfenstein et al. .
5,134,380 7/1992 Jonas .
5,170,128 12/1992 Masurat et al. .
5,170,670 12/1992 Fasching et al. .
5,177,445 1/1993 Cross .
5,198,777 3/1993 Masuda et al. .
5,206,599 4/1993 Mayer .
5,208,544 5/1993 McBrearty et al. .
5,225,785 7/1993 Mayer et al. .
5,241,280 8/1993 Aidun et al. .
5,244,550 9/1993 Inoue .
5,247,261 9/1993 Gershenfeld .
5,262,955 11/1993 Lewis .
5,270,664 12/1993 McMurtry et al. .
5,280,250 1/1994 Jayaweera et al. .
5,340,442 8/1994 Gess et al. .
5,400,247 3/1995 He .
5,450,015 9/1995 Mastico et al. .
5,492,601 2/1996 Ostermayer et al. .
5,493,910 2/1996 Hall et al. .
5,539,634 7/1996 He .
5,561,599 10/1996 Lu .
5,563,809 10/1996 Williams et al. .
5,636,126 6/1997 Heaven et al. .
5,658,432 8/1997 Heaven et al. .

FAST BASIS WEIGHT CONTROL FOR PAPERMAKING MACHINE

FIELD OF THE INVENTION

The present invention generally relates to controlling continuous sheetmaking, and more specifically, to controlling the flow of paper stock into the headbox of a papermaking machine by using measurements of the paper stock at the wire and developing a fast speed compensation signal to control said flow.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, and caliper (i.e., thickness) of the sheets at various stages in the manufacturing process. These process variables are typically controlled by, for example, adjusting the feedstock supply rate at the beginning of the process, regulating the amount of steam applied to the paper near the middle of the process, or varying the nip pressure between calendaring rollers at the end of the process. Papermaking devices well known in the art are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheetmaking systems are further described, for example, in U.S. Pat. Nos. 5,539,634, 5,022,966 4,982,334, 4,786,817, and 4,767,935.

In the manufacture of paper on continuous papermaking machines, a web of paper is formed from an aqueous suspension of fibers (stock) on a traveling mesh wire or fabric and water drains by gravity and vacuum suction through the fabric. The web is then transferred to the pressing section where more water is removed by dry felt and pressure. The web next enters the dryer section where steam heated dryers and hot air completes the drying process. The papermaking machine is essentially a de-watering, i.e., water removal, system. In the sheetmaking art, the term machine direction (MD) refers to the direction that the sheet material travels during the manufacturing process, while the term cross direction (CD) refers to the direction across the width of the sheet which is perpendicular to the machine direction.

Conventional methods for controlling the basis weight of the paper produced include regulating the paper stock flow rate from the stuff box through a basis weight or thick stock valve into the headbox. The valve is actuated in response to measurements of the paper just before the reel. The ability of this technique to smooth out disturbances however is limited due to the long time lags through the machine from the thick stock valve to the reel.

SUMMARY OF THE INVENTION

The present invention is based in part on the recognition that significant improvements in the control of the papermaking process can be achieved by diverting a portion of the stock flow from the stuff box to the headbox through a second line that is regulated by a second valve (e.g., vernier valve). The second valve is actuated in response to measurements of the basis weight of the wet stock at the wire.

In a preferred embodiment, the wet stock basis weight measurements are made with an underwire water weight sensor (referred to herein as the "$UW^3$" sensor) which is sensitive to three properties of materials: the conductivity or resistance, the dielectric constant, and the proximity of the material to the $UW^3$ sensor. Depending on the material being measured, one or more of these properties will dominate.

In a preferred embodiment, a plurality of $UW^3$ sensors are positioned underneath the wire of a papermaking machine to measure the conductivity of the aqueous wet stock. In this case, the conductivity of the wet stock is high and dominates the measurement of the $UW^3$ sensor. The conductivity of the wet stock is directly proportional to the total water weight within the wet stock, consequently the sensor provides information which can be used to monitor and control the quality of the paper sheet produced.

In one aspect, the invention is directed to a sheetmaking system having a wet end and a dry end wherein the wet end includes a headbox through which wet stock is discharged onto a water permeable moving wire, said system including:

- a source of wet stock from which wet stock is introduced into the headbox through a first line and a second line;
- a first controllable stock valve that regulates flow through the first line;
- a second controllable stock valve that regulates flow through the second line;
- a first control loop including means for obtaining basis weight measurements within said dry end and means for performing coarse adjustments to the first controllable stock valve in response to said dry end basis weight measurements, said first control loop having an associated first response time; and
- a second control loop including means for obtaining basis weight basis weight measurements within said wet end and means for performing fine adjustments to said the second controllable stock valve in response to said wet end basis weight measurements, said second control loop having an associated second response time.

In another aspect, the invention is directed to a method for controlling a sheetmaking system having a source of wet stock that is connected to a headbox through a first line and a second line and having a wet end and a dry end, with the first line having a first controllable stock valve that regulates flow through the first line and the second line having a second controllable stock valve that regulates flow through the second line, and wherein the wet stock is discharged through the headbox onto a water permeable wire, said method including the steps of:

(a) implementing a first control loop having an associated first response time by performing at least the steps of:
  (i) obtaining basis weight measurements within said dry end; and
  (ii) performing coarse adjustments to first controllable stock valve in response to said dry end basis weight measurements; and (b) implementing a second control loop having an associated second response time by performing at least the steps of:
  (i) obtaining basis weight measurements within said wet end; and
  (ii) performing fine adjustments to the second controllable stock valve in response to said wet end basis weight measurements.

In a further aspect, the invention is directed to a sheetmaking system that forms a sheet of wet stock on a moving water permeable wire and having a wet end and a dry end, and having a source of wet stock that is connected to a headbox through a first line, said system including:

means for measuring the basis weight within the dry end and generating first signals indicative of the dry end basis weight;

means for diverting a portion of wet stock flow from the source of wet stock through a second line having a second control valve that regulates flow through the second line and into the headbox;

a sensor positioned underneath and adjacent to the wire for measuring the basis weight of the wet stock and which generates second signals indicative of the wet end basis weight, said sensor being positioned downstream from a dry line which develops during operation of the system;

means for adjusting the flow rate through the first line in response to the first signals; and means for adjusting the flow rate through the second line in response to the second signals.

In yet another aspect, the invention is directed to a method of controlling the formation of a sheet of wet stock that forms on a moving water permeable wire of a de-watering machine, having a wet end and a dry end, that has a source of wet stock that is connected to a headbox through a first line having a first control valve that regulates flow through the first line and that has means for measuring the basis weight within the dry end, said method including the steps of:

(a) diverting a portion of wet stock flow from the source of wet stock through a second line having a second control valve that regulates flow through the second line;

(b) placing a sensor underneath and adjacent to the wire and downstream from a dry line which develops during operation of the machine;

(c) operating the machine and measuring the basis weight within the dry end and generating first signals indicative of the dry end basis weight and measuring the basis weight with the sensor and generating second signals indicative of the wet end basis weight;

(d) adjusting the flow rate through the first line in response to the first signals; and (e) adjusting the flow rate through the second line in response to the second signals.

DETAILED DESCRIPTION OF PREFERRED EMBODIMENTS

The present invention employs a system that includes one or more sensors that measure the basis weight of paper stock on the web or wire of a papermaking machine, e.g., fourdrinier. These sensors preferably are $UW^3$ sensors which have a very fast response time (1 msec) so that an essentially instantaneous profile of the basis weight can be obtained. Although the invention will be described as part of a fourdrinier papermaking machine, it is understood that the invention is applicable to other papermaking machines including, for example, twin wire and multiple headbox machines and to paper board formers such as cylinder machines or Kobayshi Formers. Some conventional elements of a papermaking machine are omitted in the following disclosure in order not to obscure the description of the elements of the present invention.

Figure 2A:
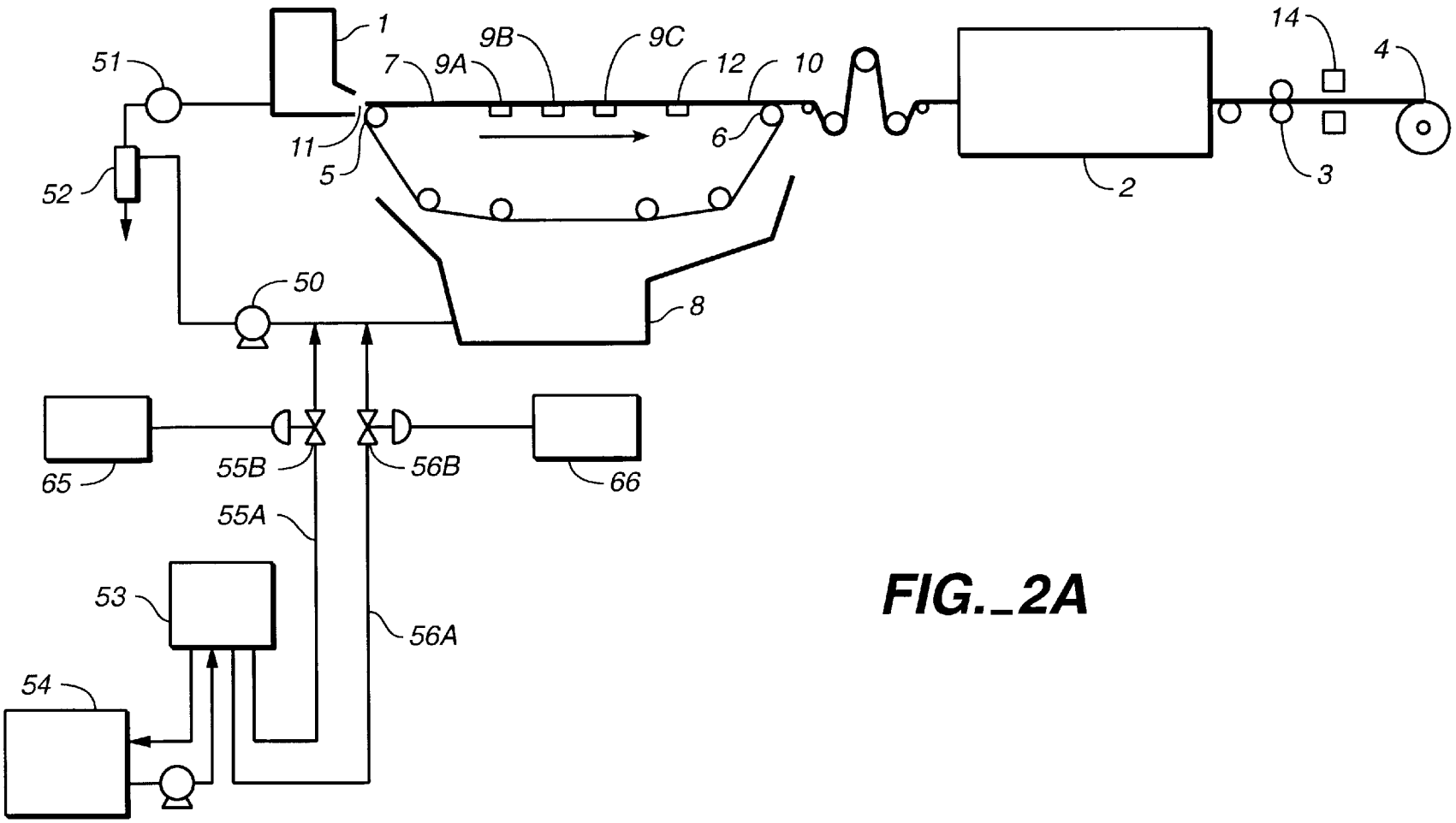
FIG. 2A shows a sheetmaking system implementing the technique of the present invention and FIG. 2B is a generalized block diagram of the control system.

FIG. 2A shows a system for producing continuous sheet material that comprises processing stages including headbox 1, web or wire 7, dryer 2, calendaring stack 3, and reel 4. Actuators (not shown) in headbox 1 discharge wet stock (e.g., pulp slurry) through a plurality of slices 11 onto supporting wire 7 which rotates between rollers 5 and 6. Foils and vacuum boxes (not shown) remove water, commonly known as "white water", from the wet stock on the wire into wire pit 8 for recycle. A scanning sensor 14 continuously traverses the finished sheet (e.g., paper) and measures properties of the finished sheet. Multiple stationary sensors could also be used. Scanning sensors are known in the art and are described, for example, in U.S. Pat. Nos. 5,094,535, 4,879,471, 5,315,124, and 5,432,353, which are incorporated herein. The finished sheet is then collected on reel 4. As used herein, the "wet end" portion of the system depicted in FIG. 2A comprises the headbox, the web, and those sections just before the dryer, and the "dry end" comprises the sections that are downstream from the dryer.

The system further includes means for measuring the basis weight of the sheet of wet stock on the wire. A preferred device is the $UW^3$ sensor which is employed singly or in combination. In one embodiment an array of $UW^3$ sensors is positioned under the wire either in the CD or MD position. For instance, the basis weight at the wet end can be measured with a CD array 12 of the $UW^3$ sensors that is positioned underneath wire 7. By this is meant that each sensor is positioned below a portion of the wire which supports the wet stock. As further described herein, each of the sensors is configured to measure the water weight of the sheet material as it passes over the array. The array provides a continuous measurement of the entire sheet material along the CD direction at the point where it passes the array. A profile made up of a multiplicity of water weight measurements at different locations in the CD is developed. In one embodiment, an average of these measurements is obtained and converted to the wet end basis weight.

Alternatively, an MD array comprised of three $UW^3$ sensors 9A, 9B, and 9C is positioned underneath wire 7. A water weight profile made up of a multiplicity of water weight measurements at different locations in the MD is developed. The array should have a minimum of 3 sensors. Typically 4 to 6 sensors are employed in tandem and positioned approximately 1 meter from the edge of the wire. Typically, the sensors are positioned about 30 to 60 cm apart from each other. Both the CD and MD array sensors are preferably positioned upstream from a dry line that forms at position 10 on the wire.

The term "water weight" refers to the mass or weight of water per unit area of the wet paper stock which is on the wire. Typically, the $UW^3$ sensors when positioned under the wire are calibrated to provide engineering units of grams per square meter (gsm). As an approximation, a reading of 10,000 gsm corresponds to paper stock having a thickness of 1 cm on the fabric. The term "basis weight" or "BW" refers to the total weight of the material per unit area. The term "dry weight" or "dry stock weight" refers to the weight of a material (excluding any weight due to water) per unit area.

Typically, the papermaking furnish or raw material is metered, diluted, mixed with any necessary additives, and finally screened and cleaned as it is introduced into headbox 1 from fan pump 50. Specifically, although stock from machine chest 54 should be reasonable free from impurities, paper machine approach systems usually utilize pressure screens 51 and centrifugal cleaners 52 to prevent contamination.

Fan pump 50 serves to mix the stock with the white water and deliver the blend to the headbox 1. To ensure a uniform dispersion to the headbox, the stock is fed from a constant head tank 53, commonly called the "stuff box," through a first line 55A that is regulated by first control valve 55B (also called the basis weight valve) and through a second line 56A that is regulated by second control valve 56B (e.g., vernier valve). Typically, the first line 56A will accommodate at least about 70% to 80% by weight of the stock from the stuff box and can be 90% or more with the remainder going through the second line 56A. The first control valve 55B is controlled by a first controller 65 that is responsive to BW measurements performed at the dry end and the second control valve 56B is controlled by a second controller 66 that is responsive to BW measurements at the wet end.

The $UW^3$ sensor detects changes in properties of the material being sensed via electrical signal measurements. The second controller 66 correlates the detected electrical measurements to changes in wet BW which are then correlated to changes in dry weight and finally to a fine control signal for controlling the second valve 56B.

Dry end BW measurements can be performed using scanning sensor 14 or using a $UW^3$ sensor. When the $UW^3$ sensor is employed, it is positioned next to the reel and underneath the paper. The $UW^3$ sensor would be measuring the dielectric constant of the paper. When using either a scanning or $UW^3$ sensor, the detected electrical signals from the sensor is correlated to a dry end BW measurement and then to a coarse control signal for controlling the first valve 55B. As is apparent, the dry end BW is essentially equal to the dry weight of the paper produced.

Figure 2B:
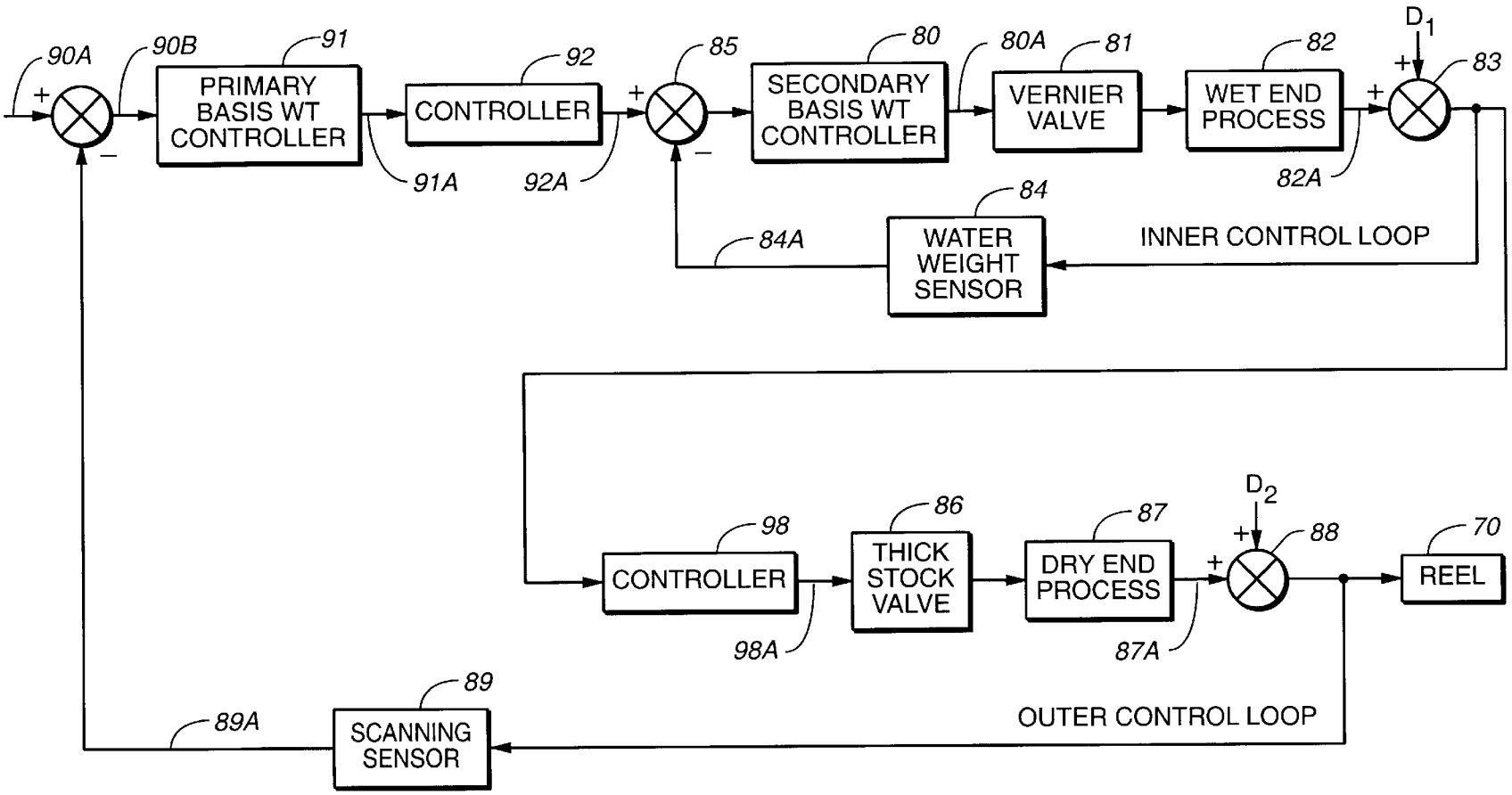

The control system is illustrated in FIG. 2B. With respect to the outer control loop, for the paper that is produced, its basis weight is influenced by the dry end process 87 as well as by disturbances in the dry end which are represented by $D_2$. The fluctuation in the basis weight of the paper is therefore represented as the sum of fluctuations in the dry process 87A and $D_2$ at summer 88. The dry end process experiences large delays of 3 to 4 minutes for example. The basis weight is continuously measured by the scanning sensor 89 located next to the reel 70. The scanning sensor transmits signals 89A which are representative of the measured basis weight to comparator 90 which also receives input signal 90A that introduces the basis weight set point. Any difference between the incoming signals delivered appears as an error signal 90B from the comparator to a primary basis weight controller 91, e.g., Dahlin controller, that produces valve control signal 91A to controller 92 which converts the input signal 91A into the predicted basis weight at the wire via a transfer function (k) for example, which information 92A is then transmitted to comparator 85.

With respect to the inner control loop, the water weight of the paper stock is influenced by the wet end process 82 as well as by disturbances in the wet end which are represented by $D_1$. The wet end process experiences only small transient delays of 15 to 30 seconds for example. The fluctuation in the water weight of the paper is therefore represented as the sum of fluctuations in the wet process 82A and $D_1$ at summer 83. The water weight of the paper stock at the wire is continuously measured with sensors 84 and the measurements therefrom are used to calculate the anticipated basis weight on the wire which is represented by signal 84A which is transmitted to comparator 85.

Any differences between the predicted basis weight at the wire signal 92A and the anticipated basis weight signal 84A appears as an error signal to the secondary basis weight controller 80, e.g., proportional integral differential controller or Dahlin controller. The secondary basis weight controller transmits signal 80A that activates divert valve 81 to increase or decrease the flow rate of wet stock into the headbox from the stuff box. Controller 80 converts the basis weight error signal from comparator 85 into valve movement signals.

As is apparent, disturbances within the fast inner control loop are corrected by the fast inner loop controller based on water weight measurements on the wire before the disturbances can affect the thick stock valve 86 of the slower outer control loop. Stock valve 86 receives signals from controller 98 which performs a transfer function (1/k) that converts signals from summer 83 that represent the predicted basis weight to valve movement signals 98A.

In addition, the closed loop response of the outer control loop is influenced by the dynamics of the inner control loop. Therefore, the faster the vernier valve 81 can respond and the faster water weight measurement is achieved, the less the outer control loop will need to act on thick stock valve 86 to correct variations as indicated by measurements by the scanning sensor 89.

Furthermore, if the dynamics of the inner control loop are faster, the phase lag of the inner control loop is less than that of the outer control loop. Consequently, the crossover frequency for the inner control loop is higher than that of the outer control loop. This means that the larger gains of the inner controller can be employed to more effectively regulate the effect of a disturbance occurring in the inner control loop, i.e., wet end, without endangering the stability of the basis weight controller. So, rather than having one controller designed to ensure stability, the inventive process employs a fast inner controller rejecting wet end disturbances and a slower outer controller ensuring that the operation is in range.

When employing the MD array of $UW^3$ sensors to provide fast control of first control valve 55B (e.g., venier valve), it is preferred to formulate a functional relationship between water weight measurements from the $UW^3$ sensors for a segment of moving wet stock on the wire and the predicted moisture level for the segment after being substantially de-watered, i.e., its dry end basis weight. The modeling technique is described herein and in U.S. patent application Ser. No. 08/789,086 filed on Jan. 27, 1997 which is incorporated herein.

The functional relationship allows water weight measurements for a segment on the wire made by the $UW^3$ sensors to be employed to predict what the dry basis weight or dry stock weight would be when the segment reaches the dry end. In this fashion, the $UW^3$ sensor measurements can be converted into dry basis weights that are compared to the target setting to obtain the error, if any.

Predicting Dry End Basis Weight From Measurements of $UW^3$ Sensors

A preferred method of predicting the dry end basis or stock weight of the paper produced involves simultaneous measurements of (1) the water contents of the paper stock on the fabric or wire of the papermaking machine at three or more locations along the machine direction of the fabric and of (2) the dry stock weight of the paper product preceding the paper stock on the fabric. In this fashion, the expected dry stock weight of the paper that will be formed by the paper stock on the fabric can be determined at that instance.

Specifically, the method of predicting the dry stock weight of a sheet of material that is moving on the water permeable wire of the above-described system includes the following steps:

a) placing three or more water weight sensors adjacent to the wire wherein the sensors are positioned at different locations in the MD and placing a sensor to measure the moisture content of the sheet of material after being substantially de-watered (this would be the scanning sensor);

b) operating the system at predetermined operating parameters and measuring the water weights of the sheet of material at the three or more locations on the wire with the water weight sensors and simultaneously measuring the dry basis weight of a part of the sheet of material that has been substantially de-watered;

c) performing bump tests to measure changes in water weight in response to perturbations in three or more operating parameters wherein each bump test is performed by alternately varying one of the operating parameters while keeping the others constant, and calculating the changes in the measurements of the three or more water weight sensors and wherein the number of bump tests correspond to the number of water weight sensors employed;

d) using said calculated changes in the measurements from step c) to obtain a linearized model describing changes in the three or more water weight sensors as a function of changes in the three or more operating parameters about said predetermined operating parameters wherein this function is expressed as an N×N matrix wherein N is equal to the number of water weight sensors employed; and e) developing a functional relationship between water weight measurements from the three or more water weight sensors for a segment of the moving sheet of material at the fabric and the predicted moisture level for the segment after being substantially de-watered.

Preferably, the bump tests comprise varying the flow rate of the aqueous fiber stock onto the fabric, freeness of the fiber stock, and concentration of fiber in the aqueous fiber stock. By continuously monitoring the water weight levels of the paper stock on the fabric, it is possible to predict the quality (i.e., dry stock weight) of the product.

The water drainage profile on a fourdrinier wire is a complicated function principally dependent on the arrangement and performance of drainage elements, characteristics of the wire, tension on the wire, stock characteristics (for example freeness, pH and additives), stock thickness, stock temperature, stock consistency and wire speed. It has demonstrated that particularly useful drainage profiles can be generated by varying the following process parameters: 1) total water flow which depends on, among other things, the headbox delivery system, head pressure and slice opening and slope position; 2) freeness which depends on, among other things, the stock characteristics and refiner power; and 3) dry stock flow and headbox consistency.

Water weight sensors placed at strategic locations along the papermaking fabric can be used to profile the de-watering process (hereinafter referred to as "drainage profile"). By varying the above stated process parameters and measuring changes in the drainage profile, one can then construct a model which simulates the wet end paper process dynamics. Conversely one can use the model to determine how the process parameters should be varied to maintain or produce a specified change in the drainage profile. Furthermore the dry stock weight of the web on the wire can be predicted from the water weight drainage profiles.

Three water weight sensors 9A, 9B, and 9C are illustrated to measure the water weight of the paper stock on the wire. The position along the fabric at which the three sensors are located are designated "h", "m", and "d", respectively. More than three water weight sensors can be employed. It is not necessary that the sensors be aligned in tandem, the only requirement is that they are positioned at different machine directional positions. Typically, readings from the water weight sensor at location "h" which is closest to the headbox will be more influenced by changes in stock freeness than in changes in the dry stock since changes in the latter is insignificant when compared to the large free water weight quantity. At the middle location "m", the water weight sensor is usually more influenced by changes in the amount of free water than by changes in the amount of dry stock. Most preferably location "m" is selected so as to be sensitive to both stock weight and free changes. Finally, location "d", which is closest to the drying section, is selected so that the water weight sensor is sensitive to changes in the dry stock because at this point of the de-water process the amount of water bonded to or associated with the fiber is proportional to the fiber weight. This water weight sensor is also sensitive to changes in the freeness of the wire although to a lesser extent. Preferably, at position "d" sufficient amounts of water have been removed so that the paper stock has an effective consistency whereby essentially no further fiber loss through the fabric occurs.

In measuring paper stock, the conductivity of the mixture is high and dominates the measurement of the sensor. The conductivity of the paper stock is directly proportional to the total water weight within, consequently providing information which can be used to monitor and control the quality of the paper sheet produced by the papermaking system. In order to use this sensor to determine the weight of fiber in a paper stock mixture by measuring its conductivity, the paper stock is in a state such that all or most of the water is held by the fiber. In this state, the water weight of the paper stock relates directly to the fiber weight and the conductivity of the water weight can be measured and used to determine the weight of the fiber in the paper stock.

To implement this technique, three water weight sensors are used to measure the dependence of the drainage profile of water from the paper stock through the wire on three machine operation parameters: (1) total water flow, (2) freeness of paper stock, and (3) dry stock flow or headbox consistency. Other applicable parameters include for example, (machine speed and vacuum level for removing water). For the case of three process parameters the minimum is three water weight sensors. More can be used for more detailed profiling.

A preferred form of modeling uses a baseline configuration of process parameters and resultant drainage profile, and then measures the effect on the drainage profile in response to a perturbation of an operation parameter of the fourdrinier machine. In essence this linearizes the system about the neighborhood of the baseline operating configuration. The perturbations or bumps are used to measure first derivatives of the dependence of the drainage profile on the process parameters.

Once a set of drainage characteristic curves has been developed, the curves, which are presented as a 3×3 matrix, can be employed to, among other things, predict the water content in paper that is made by monitoring the water weight along the wire by the water weight sensors. This information is employed to control the vernier valve.

Bump Tests

The term "bump test" refers to a procedure whereby an operating parameter on the papermaking machine is altered and changes of certain dependent variables resulting therefrom are measures. Prior to initiating any bump test, the papermaking machine is first operated at predetermined baseline conditions. By "baseline conditions" is meant those operating conditions whereby the machine produces paper. Typically, the baseline conditions will correspond to standard or optimized parameters for papermaking. Given the expense involved in operating the machine, extreme conditions that may produce defective, non-useable paper is to be avoided. In a similar vein, when an operating parameter in the system is modified for the bump test, the change should not be so drastic as to damage the machine or produce defective paper. After the machine has reached steady state or stable operations, the water weights at each of the three sensors are measured and recorded. Sufficient number of measurements over a length of time are taken to provide representative data. This set of steady-state data will be compared with data following each test. Next, a bump test is conducted. The following data were generated on a Beloit Concept 3 papermaking machine, manufactured by Beloit Corporation, Beloit, Wis. The calculations were implemented using a microprocessor using Labview 4.0.1 software from National Instrument (Austin Tex.).

Figure 7:
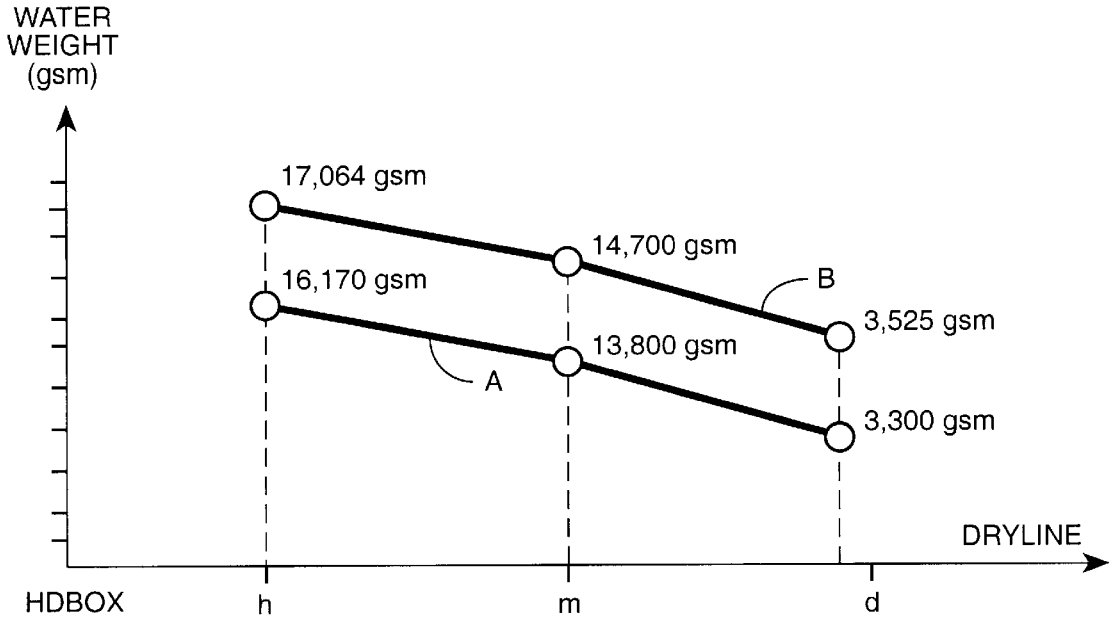
FIG. 7 is a graph of water weight versus wire position of a papermaking machine.

(1) Dry stock flow test. The flowrate of dry stock delivered to the headbox is changed from the baseline level to alter the paper stock composition. Once steady state conditions are reached, the water weights are measured by the three sensors and recorded. Sufficient number of measurements over a length of time are taken to provide representative data. FIG. 7 is a graph of water weight vs. wire position measured during baseline operations and during a dry stock flow bump test wherein the dry stock was increase by 100 gal/min from a baseline flow rate of 1629 gal/min. Curve A connects the three water weight measurements during baseline operations and curve B connects the measurements during the bump test. As is apparent, increasing the dry stock flow rate causes the water weight to increase. The reason is that because the paper stock contains a high percentage of pulp, more water is retained by the paper stock. The percentage difference in the water weight at positions h, m, and d (corresponding to sensors 9A, 9B and 9C, respectively, in FIG. 2) along the wire are +5.533%, +6.522%, and +6.818%, respectively.

For the dry stock flow test, the controls on the papermaking machine for the basic weight and moisture are switched off and all other operating parameters are held as steady as possible. Next, the stock flow rate is increased by 100 gal/min. for a sufficient amount of time, e.g., about 10 minutes. During this interval, measurements from the three sensors are recorded and the data derived therefrom are shown in FIG. 7.

Figure 8:
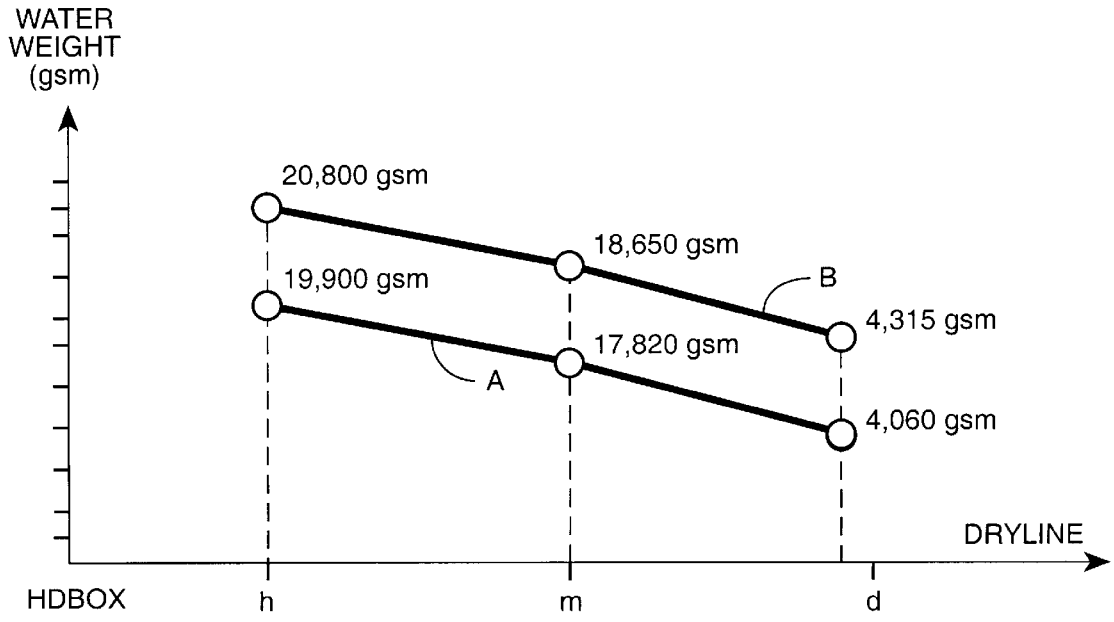
FIG. 8 is a graph of freeness versus wire position.

(2) Freeness test. As described previously, one method of changing the freeness of paper stock is to alter the power to the refiner which ultimately effects the level of grinding the pulp is subjected to. During the freeness test, once steady state conditions are reached, the water weights at each of the three sensors are measured and recorded. In one test, power to the refiner was increased from about 600 kw to about 650 kw. FIG. 8 is a graph of water weight vs. freeness measured during baseline operations (600 kw) (curve A) and during the steady state operations after an additional 50 kw are added (curve B). As expected, the freeness was reduced resulting in an increase in the water weight as in the dry stock flow test. Comparison of the data showed that the percentage difference in the water weight at positions h, m, and d are +4.523%, +4.658%, and +6.281%, respectively.

(3) Total paper stock flow rate (slice) test. One method of regulating the total paper stock flow rate from the headbox is to adjust aperture of the slice. During this test, once steady state conditions are reached, the water weights at each of the three sensors are measured and recorded. In one test, the slice aperture was raised from about 1.60 in. (4.06 cm) to about 1.66 in. (4.2 cm) thereby increasing the flow rate. As expected, the higher flow rate increased the water weight. Comparison of the data showed that the percentage difference in the water weight at positions h, m, and d are +9.395%, +5.5%, and +3.333%, respectively. (The measurement at position m of 5.5% is an estimate since the sensor at this location was not in service when the test was performed.)

The Drainage Characteristic Curves (DCC)

From the previously described bump tests one can derive a set of drainage characteristic curves (DCC). The effect of changes in three process parameters on the three water weight sensor values provides nine partial derivatives which form a 3×3 DCC matrix. Generally, when employing n number of water weight sensors mounted on the wire and m bump tests, a n×m matrix is obtained.

Specifically, the 3×3 DCC matrix is given by:

$$DC_{The}DC_{Tm}DC_{Td}$$

$$DC_{Fh}DC_{Fm}DC_{Fd}$$

$$DC_{Sh}DC_{Sm}DC_{Sd}$$

where T, F, S refer to results from bumps in the total water flow, freeness, and dry stock flow, respectively, and h, m, and d designate the positions of the sensors mounted along the wire or fabric.

The matrix row components $[DC_{The}DC_{Tm}DC_{Td}]$ are defined as the percentage of water weight change on total water weight at locations h, m, and d based on the total flow rate bump tests. More precisely, for example, "$DC_{The}$" is defined as the difference in percentage water weight change at position h at a moment in time just before and just after the total flow rate bump test. $DC_{Tm}$ and $DC_{Td}$ designate the values for the sensors located at positions m and d, respectively. Similarly, the matrix row components $[DC_{Fh}DC_{Fm}DC_{Fd}]$ and $[DC_{Sh}DC_{Sm}DC_{Sd}]$ are derived from the freeness and dry stock bump tests, respectively.

Components $DC_{The}$, $DC_{Fm}$ and $DC_{Sd}$ on the DDC matrix are referred to pivotal coefficients and by Gauss elimination, for example, they are used to identify the wet end process change as further described herein. If a pivot coefficient is too small, the uncertainty in the coefficients will be amplified during the Gauss elimination process. Therefore, preferably these three pivotal coefficients should be in the range of about 0.03 to 0.10 which corresponds to about 3% to 10% change in the water weight during each bump test.

Drainage Profile Change

Based on the DCC matrix, the drainage profile change can be represented as a linear combination of changes in the different process parameters. Specifically, using the DCC matrix, the percentage change in the drainage profile at each location may be computed as a linear combination of the individual changes in the process parameters: total water flow, freeness, and dry stock flow. Thus:

$$\Delta DP\ \%\ (h,t)=DCTh*w+DCFh*f+DCSh*s,$$

$$\Delta DP\ \%\ (m,t)=DCTm*w+DCFm*f+DCSm*s,$$

$$\Delta DP\ \%\ (d,t)=DCTd*w+DCFd*f+DCSd*s,$$

where (wwhere (w, f, s) refer to changes in total water flow, freeness, and dry stock flow respectively, and the DC's are components of the DCC matrix.

By inverting this system of linear equations, one may solve for the values of (w, f, s) needed to produce a specified drainage profile change (ΔDP % (h), ΔDP % (m), ΔDP % (d). Letting A represent the inverse of the DCC matrix, $$\begin{bmatrix} A_{11} & A_{12} & A_{13} \\ A_{21} & A_{22} & A_{23} \\ A_{31} & A_{32} & A_{33} \end{bmatrix} \begin{bmatrix} \Delta DP\%\,(h) \\ \Delta DP\%\,(m) \\ \Delta DP\%\,(d) \end{bmatrix} = \begin{bmatrix} w \\ f \\ s \end{bmatrix} \text{ or}$$

$$w = A_{11} * \Delta DP\%\,(h) + A_{12} * \Delta DP\%\,(m) + A_{13} * \Delta DP\%\,(d)$$

$$f = A_{21} * \Delta DP\%\,(h) + A_{22} * \Delta DP\%\,(m) + A_{23} * \Delta DP\%\,(d)$$

$$s = A_{31} * \Delta DP\%\,(h) + A_{32} * \Delta DP\%\,(m) + A_{33} * \Delta DP\%\,(d)$$

The above equation shows explicitly how inverting the DCC matrix allows one to compute the (w, f, s) needed to effect a desired change in drainage profile, (ΔDP % (h), ΔDP % (m), ΔDP % (d)).

Empirically, the choice of the three operating parameters, the location of the sensors, and the size of the bumps produces a matrix with well behaved pivot coefficients, and the matrix can thus be inverted without undue noise.

By continuously comparing the dry weight measurement from scanner 14 in FIG. 2 with the water weight profiles measured at sensors h, m, and d, one can make a dynamic estimate of the final dry stock weight will be for the paper stock that is at the position of scanner 14.

Dry Stock Prediction

At location d which is closest to the drying section, the state of the paper stock is such that essentially all of the water is held by the fiber. In this state, the amount of water bonded to or associated with the fiber is proportional to the fiber weight. Thus the sensor at location d is sensitive to changes in the dry stock and is particularly useful for predicting the weight of the final paper stock. Based on this proportionality relation: DW(d)=U(d)*C(d), where DW(d) is the predicted dry stock weight at location d, U(d) is the measured water weight at location d and C(d) is a variable of proportionality relating DW to U and may be referred to as the consistency. Further, C(d) is calculated from historical data of the water weight and dry weight measured by the scanning sensor at reel-up.

Subsequent to position d (9C) in the papermaking machine (see FIG. 2A), the sheet of stock is dried and scanning sensor 14 measures the final dry stock weight of the paper product. Since there is essentially no fiber loss subsequent to location d, it may be assumed that DW(d) is equal to the final dry stock weight and thus one can calculate the consistency C(d) dynamically.

Having obtained these relations, one can then predict the effect of changes in the process parameters on the final dry stock weight. As derived previously the DCC matrix predicts the effect of process changes on the drainage profile. Specifically in terms of changes in total water flow w, freeness f, and dry stock flow s, the change in U(d) is given by:

$$\Delta U(d)/U(d)=DC_{Td}$$

where Ref(cd) is a dynamic calculated value based on current dry weight sensor and historical water weight sensory readings where the α's are defined to be gain coefficients which were obtained during the three bump tests previously described. Finally, the perturbed dry stock weight at location d is then given by:

$$Dw(d)=U(d)*\ \{1+[\alpha_T DC_{Td}*w+\alpha_F DC_{Fd}*f+d_S DC_{Sd}*s]\}\text{Ref}\ (c)$$

The last equation thus describes the effect on dry stock weight due to a specified change in process parameters. Conversely, using the inverse of the DCC matrix one can also deduce how to change the process parameters to produce a desired change in dry weight (s), freeness (f) and total water flow (w) for product optimization.

Under Wire Water Weight ($UW^3$) Sensor

Figure 1B:
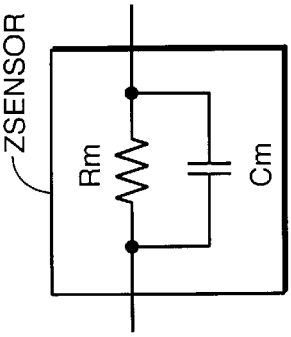
FIG. 1A shows a basic block diagram of the under wire water weight ($UW^3$) sensor and FIG. 1B shows the equivalent circuit of the sensor block.
Figure 1A:
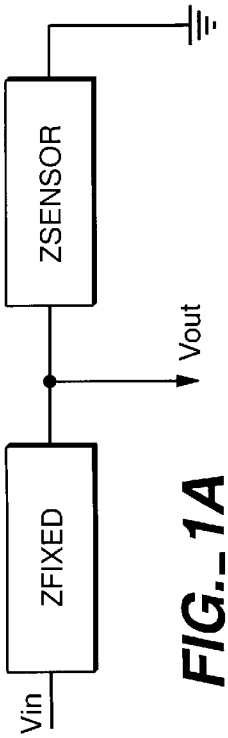

In its broadest sense, the sensor can be represented as a block diagram as shown in FIG. 1A, which includes a fixed impedance element (Zfixed) coupled in series with a variable impedance block (Zsensor) between an input signal (Vin) and ground. The fixed impedance element may be embodied as a resistor, an inductor, a capacitor, or a combination of these elements. The fixed impedance element and the impedance, Zsensor, form a voltage divider network such that changes in impedance, Zsensor, results in changes in voltage on Vout. The impedance block, Zsensor, shown in FIG. 1A is representative of two electrodes and the material residing between the electrodes. The impedance block, Zsensor, can also be represented by the equivalent circuit shown in FIG. 1B, where Rm is the resistance of the material between the electrodes and Cm is the capacitance of the material between the electrodes. The sensor is further described in U.S. patent application Ser. No. 08/766,864 filed on Dec. 13, 1996, which is incorporated herein.

As described above, wet end BW measurements can be obtained with one or more $UW^3$ sensors. Moreover, when more than one is employed, preferably the sensors are configured in an array.

The sensor is sensitive to three physical properties of the material being detected: the conductivity or resistance, the dielectric constant, and the proximity of the material to the sensor. Depending on the material, one or more of these properties will dominate. The material capacitance depends on the geometry of the electrodes, the dielectric constant of the material, and its proximity to the sensor. For a pure dielectric material, the resistance of the material is infinite (i.e. Rm=∞) between the electrodes and the sensor measures the dielectric constant of the material. In the case of highly conductive material, the resistance of the material is much less than the capacitive impedance (i.e. $Rm \ll Z_{Cm}$), and the sensor measures the conductivity of the material.

To implement the sensor, a signal Vin is coupled to the voltage divider network shown in FIG. 1A and changes in the variable impedance block (Zsensor) is measured on Vout. In this configuration the sensor impedance, Zsensor, is: Zsensor=Zfixed*Vout/(Vin−Vout) (Eq. 1). The changes in impedance of Zsensor relates physical characteristics of the material such as material weight, temperature, and chemical composition. It should be noted that optimal sensor sensitivity is obtained when Zsensor is approximately the same as or in the range of Zfixed.

Cell Array

Figure 4A:
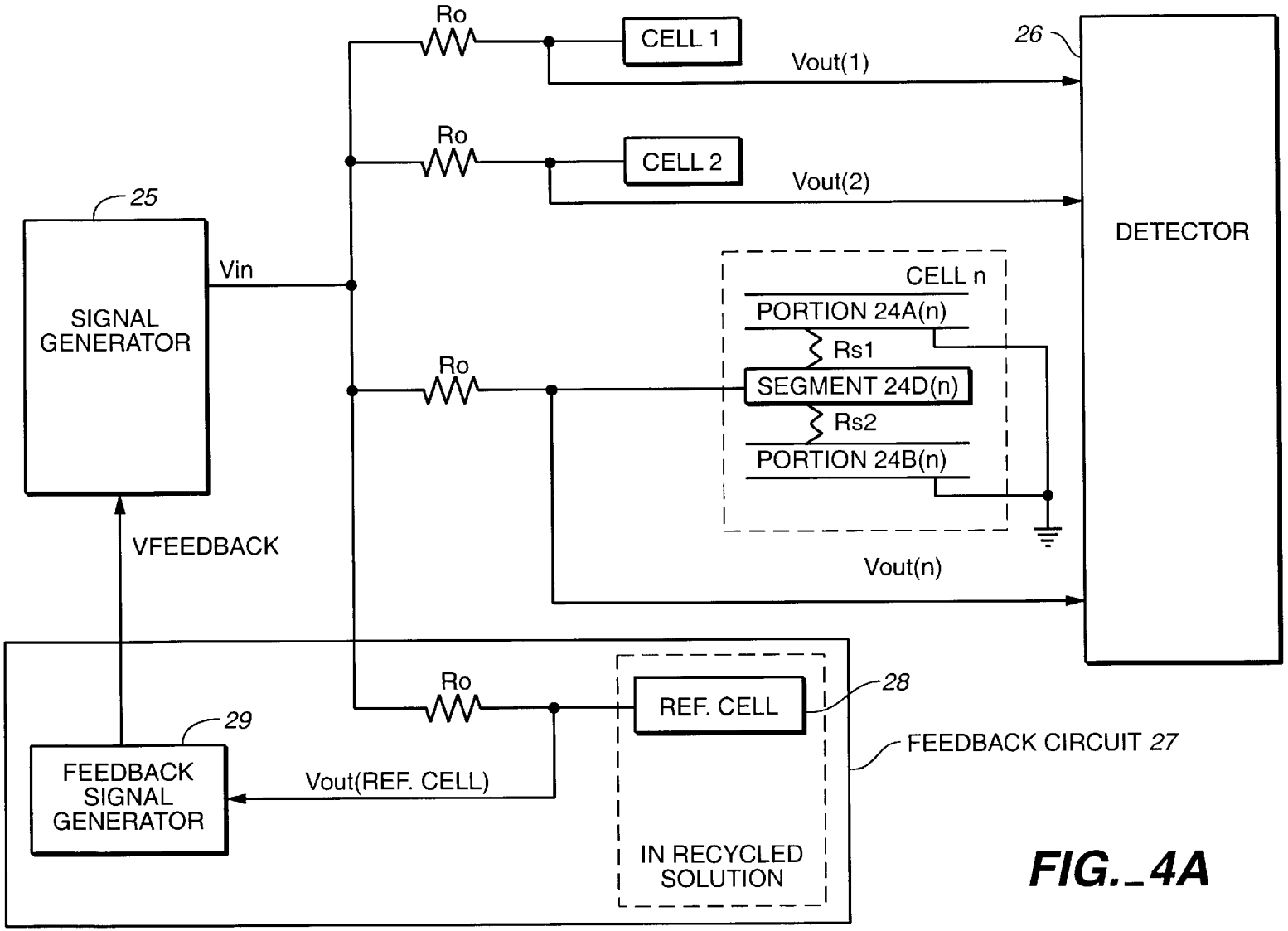
FIG. 4A shows an electrical representation of an embodiment of the $UW^3$ sensor.
Figure 4B:
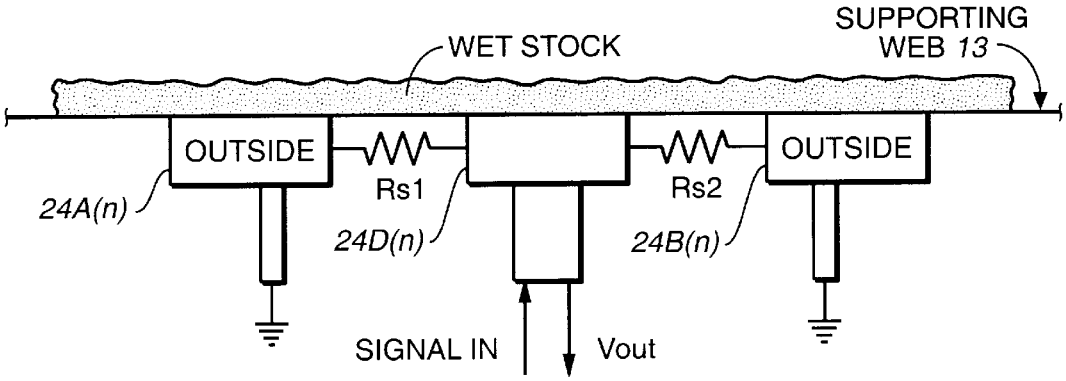
FIG. 4B shows a cross-sectional view of a cell used within the $UW^3$ sensor and its general physical position within a sheetmaking system in accordance with one implementation of the sensor.

FIG. 4A shows an electrical representation of cell array 24 (including cells 1–n) and the manner in which it functions to sense changes in conductivity of the aqueous mixture. As shown, each cell is coupled to Vin from signal generator 25 through an impedance element which, in this embodiment, is resistive element Ro. Referring to cell n, resistor Ro is coupled to the center sub-electrode 24D(*n*). The outside electrode portions 24A(*n*) and 24B(*n*) are both coupled to ground. Also shown in FIG. 4A are resistors Rs1 and Rs2 which represent the conductance of the aqueous mixture between each of the outside electrodes and the center electrode. The outside electrodes are designed to be essentially equidistant from the center electrode and consequently the conductance between each and the center electrode is essentially equal (Rs1=Rs2=Rs). As a result, Rs1 and Rs2 form a parallel resistive branch having an effective conductance of half of Rs (i.e. Rs/2). It can also be seen that resistors Ro, Rs1, and Rs2 form a voltage divider network between Vin and ground. FIG. 4B also shows the cross-section of one implementation of a cell electrode configuration with respect to a sheetmaking system in which electrodes 24A(*n*), 24B(*n*), and 24D(*n*) reside directly under the web 13 immersed within the aqueous mixture.

The sensor apparatus is based on the concept that the resistance Rs of the aqueous mixture and the weight/amount of an aqueous mixture are inversely proportional. Consequently, as the weight increases/decreases, Rs decreases/increases. Changes in Rs cause corresponding fluctuations in the voltage Vout as dictated by the voltage divider network including Ro, Rs1, and Rs2.

The voltage Vout from each cell is coupled to detector 26. Hence, variations in voltage directly proportional to variations in resistivity of the aqueous mixture are detected by detector 26 thereby providing information relating to the weight and amount of aqueous mixture in the general proximity above each cell. Detector 26 may include means for amplifying the output signals from each cell and in the case of an analog signal will include a means for rectifying the signal to convert the analog signal into a DC signal. In one implementation well adapted for electrically noisy environments, the rectifier is a switched rectifier including a phase lock-loop controlled by Vin. As a result, the rectifier rejects any signal components other than those having the same frequency as the input signal and thus provides an extremely well filtered DC signal. Detector 26 also typically includes other circuitry for converting the output signals from the cell into information representing particular characteristics of the aqueous mixture.

FIG. 4A also shows feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if water weight is desired to be sensed then the water weight is kept constant so that any voltage changes generated by the reference cell are due to physical characteristics other than water weight changes. In one embodiment, reference cell 28 is immersed in an aqueous mixture of recycled water which has the same chemical and temperature characteristics of the water in which cell array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout(ref. cell) generated by the reference cell 28 are due to changes in the conductivity of the aqueous mixture, not the weight. Feedback signal generator 29 converts the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout(ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

Figure 3:
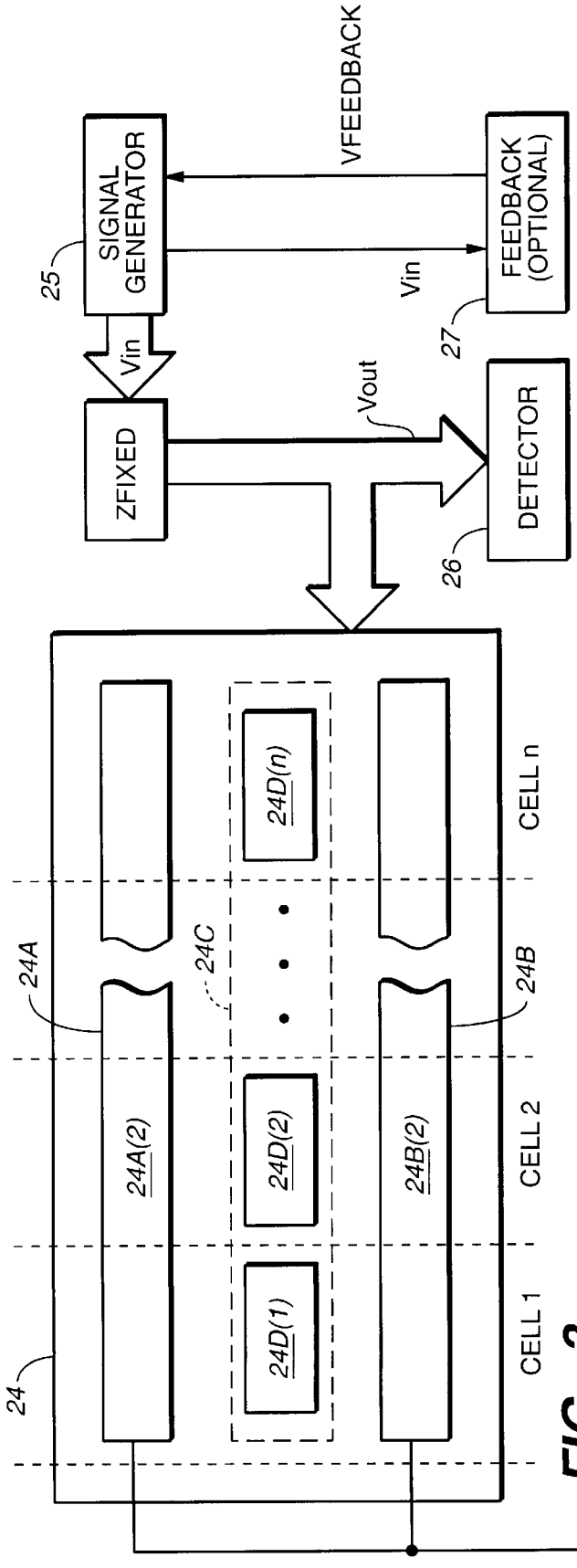
FIG. 3 shows a block diagram of the $UW^3$ sensor including the basic elements of the sensor.
Figure 5A:
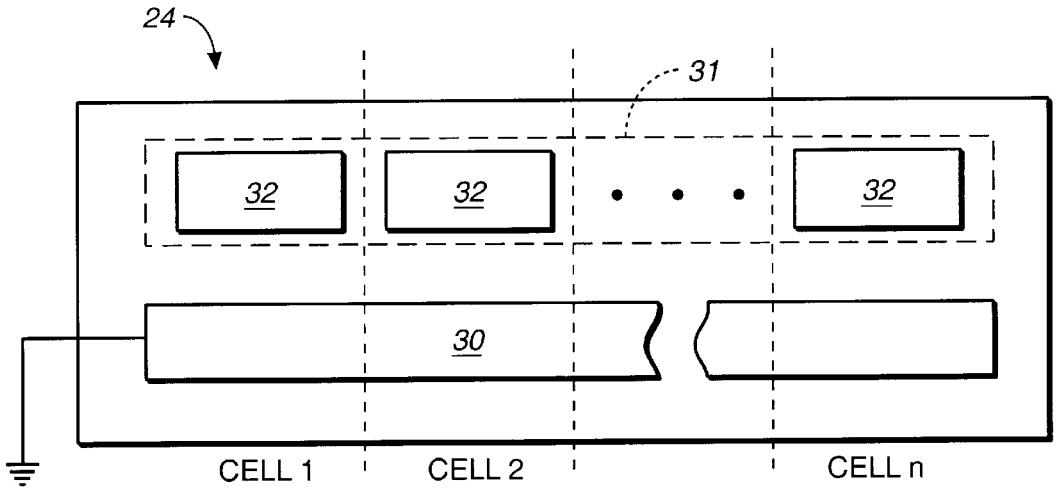
FIG. 5A shows a second embodiment of the cell array used in the $UW^3$ sensor.
Figure 5B:
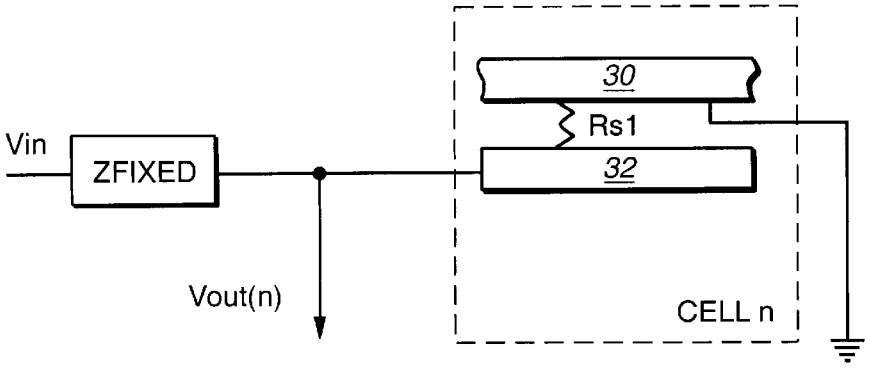
FIG. 5B shows the configuration of a single cell in the second embodiment of the cell array shown in FIG. 5A.

One reason for configuring the cell array as shown in FIG. 3, with the center electrode placed between two grounded electrodes, is to electrically isolate the center electrode and to prevent any outside interaction between the center electrode and other elements within the system. However, it should also be understood that the cell array can be configured with only two electrodes. FIG. 5A shows a second embodiment of the cell array for use in the sensor. In this embodiment, the sensor includes a first grounded elongated electrode 30 and a second partitioned electrode 31 including sub-electro 32. A single cell is defined as including one of the sub-electrodes 32 and the portion of the grounded electrode 30 which is adjacent to the corresponding sub-electrode. FIG. 5A shows cells 1–n each including a sub-electrode 32 and an adjacent portion of electrode 30. FIG. 5B shows a single cell n, wherein the sub-electrode 32 is coupled to Vin from the signal generator 25 through a fixed impedance element Zfixed and an output signal Vout is detected from the sub-electrode 32. It should be apparent that the voltage detected from each cell is now dependent on the voltage divider network, the variable impedance provided from each cell and the fixed impedance element coupled to each sub-electrode 32. Hence, changes in conductance of each cell is now dependent on changes in conductance of Rs1. The remainder of the sensor functions in the same manner as with the embodiment shown in FIG. 4A. Specifically, the signal generator provides a signal to each cell and feedback circuit 27 compensates Vin for variations in conductance that are not due to the characteristic being measured.

The cells shown in FIGS. 5A and 5B may alternatively be coupled such that Vin is coupled to electrode 30 and each of sub-electrodes 32 are coupled to fixed impedance elements which, in turn, are coupled to ground.

Figure 6A:
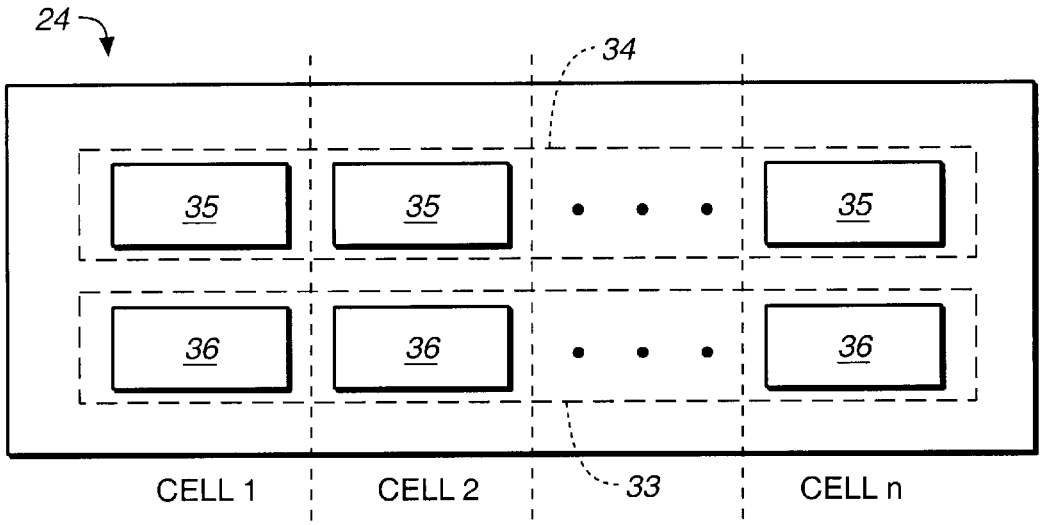
FIG. 6A shows a third embodiment of the cell array used in the $UW^3$ sensor.
Figure 6B:
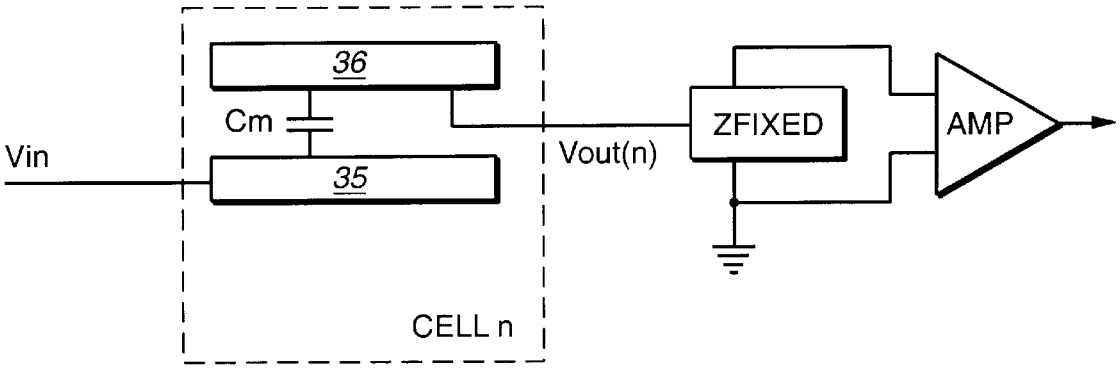
FIG. 6B shows the configuration of a single cell in the third embodiment of the cell array shown in FIG. 6A.

In still another embodiment of the cell array shown in FIGS. 6A and 6B, the cell array includes first and second elongated spaced apart partitioned electrodes 33 and 34, each including first and second sets of sub-electrodes 36 and 35, (respectively). A single cell (FIG. 6B) includes pairs of adjacent sub-electrodes 35 and 36, wherein sub-electrode 35 in a given cell is independently coupled to the signal generator and sub-electrode 36 in the given cell provides Vout to a high impedance detector amplifier which provides Zfixed. This embodiment is useful when the material residing between the electrodes functions as a dielectric making the sensor impedance high. Changes in voltage Vout is then dependent on the dielectric constant of the material. This embodiment is conducive to being implemented at the dry end (FIG. 2A) of a sheetmaking system (and particularly beneath and in contact with continuous sheet 18) since dry paper has high resistance and its dielectric properties are easier to measure.

In a physical implementation of the sensor shown in FIG. 1A for performing individual measurements of more than one area of a material, one electrode of the sensor is grounded and the other electrode is segmented so as to form an array of electrodes (described in detail below). In this implementation, a distinct impedance element is coupled between Vin and each of the electrode segments. In an implementation for performing individual measurements of more than one area of a material of the sensor, the positions of the fixed impedance element and Zsensor are reversed from that shown in FIG. 1A. One electrode is coupled to Vin and the other electrode is segmented and coupled to a set of distinct fixed impedances which, in turn, are each coupled to ground. Hence, neither of the electrodes are grounded in this implementation of the sensor.

FIG. 3 illustrates a block diagram of one implementation of the sensor apparatus including cell array 24, signal generator 25, detector 26, and optional feedback circuit 27. Cell array 24 includes two elongated grounded electrodes 24A and 24B and center electrode 24C spaced apart and centered between electrodes 24A and 24B and made up of sub-electrodes 24D(1)–24D(*n*). A cell within array 24 is defined as including one of sub-electrodes 24D situated between a portion of each of the grounded electrodes 24A and 24B. For example, cell 2 includes sub-electrode 24D(2) and grounded electrode portions 24A(2) and 24B(2). For use in the system as shown in FIG. 2, cell array 24 resides beneath and in contact with supporting web 13 and can be positioned either parallel to the machine direction (MD) or to the cross-direction (CD) depending on the type of information that is desired. In order to use the sensor apparatus to determine the weight of fiber in a wetstock mixture by measuring its conductivity, the wetstock must be in a state such that all or most of the water is held by the fiber. In this state, the water weight of the wetstock relates directly to the fiber weight and the conductivity of the water weight can be measured and used to determine the weight of the fiber in the wetstock.

Each cell is independently coupled to an input voltage (Vin) from signal generator 25 through an impedance element Zfixed and each provides an output voltage to voltage detector 26 on bus Vout. Signal generator 25 provides Vin. In one embodiment Vin is an analog waveform signal, however other signal types may be used such as a DC signal. In the embodiment in which signal generator 25 provides a waveform signal it may be implemented in a variety of ways and typically includes a crystal oscillator for generating a sine wave signal and a phase lock loop for signal stability. One advantage to using an AC signal as opposed to a DC signal is that it may be AC coupled to eliminate DC off-set.

Detector 26 includes circuitry for detecting variations in voltage from each of the sub-electrodes 24D and any conversion circuitry for converting the voltage variations into useful information relating to the physical characteristics of the aqueous mixture. Optional feedback circuit 27 includes a reference cell also having three electrodes similarly configured as a single cell within the sensor array. The reference cell functions to respond to unwanted physical characteristic changes in the aqueous mixture other than the physical characteristic of the aqueous mixture that is desired to be measured by the array. For instance, if the sensor is detecting voltage changes due to changes in water weight, the reference cell is configured so that it measures a constant water weight. Consequently, any voltage/conductivity changes exhibited by the reference cell are due to aqueous mixture physical characteristics other than weight changes (such as temperature and chemical composition). The feedback circuit uses the voltage changes generated by the reference cell to generate a feedback signal (Vfeedback) to compensate and adjust Vin for these unwanted aqueous mixture property changes (to be described in further detail below). The non-weight related aqueous mixture conductivity information provided by the reference cell may also provide useful data in the sheetmaking process.

Individual cells within sensor 24 can be readily employed in the system of FIGS. 2A and 2B so that each of the individual cells (1 to n) corresponds to each of the individual $UW^3$ sensors (or elements) 9A, 9B, and 9C. The length of each sub-electrode (24D(*n*)) determines the resolution of each cell. Typically, its length ranges from 1 in. to 6 in.

The sensor cells are positioned underneath the web, preferably upstream of the dry line, which on a fourdrinier, typically is a visible line of demarcation corresponding to the point where a glossy layer of water is no longer present on the top of the stock.

A method of constructing the array is to use a hydrofoil or foil from a hydrofoil assembly as a support for the components of the array. In a preferred embodiment, the grounded electrodes and center electrodes each has a surface that is flushed with the surface of the foil.

It should be understood that in the case in which an array 24 of sensor cells as shown in FIG. 3 cannot be placed along the machine or cross direction of the sheetmaking system due to obstructions within the system, then individual sensor cells are positioned along the cross or machine direction of the system. Each cell can then individually sense changes in conductivity at the point at which they are positioned which can then be used to determined basis weight. As shown in FIGS. 3 and 4*b* a single cell comprises at least one grounded electrode (either 24A(*n*) or 24B(*n*) or both) and a center electrode 24D(*n*).

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A sheetmaking system having a wet end and a dry end wherein the wet end includes a headbox through which wet stock is discharged onto a water permeable moving wire, said system comprising:

a source of wet stock from which wet stock is introduced into the headbox through a first line and a second line;

a first controllable stock valve that regulates flow through the first line;

a second controllable stock valve that regulates flow through the second line;

a first control loop including means for obtaining basis weight measurements within said dry end and means for performing coarse adjustments to the first controllable stock valve in response to said dry end basis weight measurements, said first control loop having an associated first response time; and a second control loop including means for obtaining basis weight basis weight measurements within said wet end and means for performing fine adjustments to said the second controllable stock valve in response to said wet end basis weight measurements, said second control loop having an associated second response time.

2. The system of claim 1 wherein the flow rate through the first line is higher than the flow rate through the second line.

3. The system of claim 1 wherein the second response time is less than that of the first response time.

4. The system of claim 1 wherein the means for obtaining the basis weight measurements within the wet end comprises a sensor that is positioned under the moving wire which generate signals that are indicative of the basis weight of the wet stock on the wire.

5. The system of claim 4 wherein the sensor comprises a plurality of individual water weight sensor cells arranged essentially in a row parallel to the direction of movement of the wire.

6. The system of claim 4 wherein the sensor includes an electrode configuration for electrically detecting property changes in the wet stock being processed in said sheetmaking system to obtain the wet end basis weight measurements.

7. The system of claim 1 wherein the means for obtaining the basis weight within the dry end comprises a scanning type sensor positioned at the dry end which generates signals that are indicative of the dry end basis weight.

8. The system of claim 1 wherein the means for obtaining the basis weight within the dry end comprise a sensor positioned underneath the sheet at the dry end and which generates signals that are indicative of the dry end basis weight, wherein the sensor includes an electrode configuration for electrically detecting property changes in the sheet being produced.

9. A method for controlling a sheetmaking system having a source of wet stock that is connected to a headbox by a first line and a second line and having a wet end and a dry end, with the first line having a first controllable stock valve that regulates flow through the first line and the second line having a second controllable stock valve that regulates flow through the second line, and wherein the wet stock is discharged through the headbox discharged onto a water permeable wire, said method comprising the steps of:

(a) implementing a first control loop having an associated first response time by performing at least the steps of:

(i) obtaining basis weight measurements within said dry end; and (ii) performing coarse adjustments to first controllable stock valve in response to said dry end basis weight measurements; and (b) implementing a second control loop having an associated second response time by performing at least the steps of:

(i) obtaining basis weight measurements within said wet end; and (ii) performing fine adjustments to the second controllable stock valve in response to said wet end basis weight measurements.

10. The method of claim 9 wherein said step of performing coarse adjustments comprises adjusting the flow through the first stock valve and said step of performing fine adjustments includes comprises adjusting flow through the second stock valve.

11. The method of claim 9 wherein the flow rate through the first line is higher than the flow rate through the second line.

12. The method of claim 9 wherein the second response time is less than the first response time.

13. The method of claim 9 wherein said step of performing said coarse adjustments comprises controlling a first stock valve using a Dahlin controller and said step of performing said fine adjustments comprises controlling a second stock valve using a PID controller.

14. The method of claim 9 wherein the step (b)(i) comprises positioning a sensor under the moving wire which generate signals that are indicative of the basis weights of the wet stock on the wire.

15. The method of claim 14 wherein the sensor comprises a plurality of individual sensor cells arranged essentially in a row parallel to the direction of movement of the wire.

16. The method of claim 14 wherein the sensor includes an electrode configuration for electrically detecting property changes of wet stock processed in said sheetmaking system to obtain the wet end basis weight measurements.

17. The method of claim 9 wherein the step (a)(i) comprises positioning a scanning type sensor at the dry end which generates signals that are indicative of the dry end basis weight.

18. The method of claim 9 wherein the step (b)(i) comprises positioning a sensor at the dry end and underneath the sheet and which generates signals that are indicative of the dry end basis weight wherein the sensor includes an electrode configuration for electrically detecting property changes of the sheet being produced in said sheetmaking system.

19. In a sheetmaking system that forms a sheet of wet stock on a moving water permeable wire and having a wet end and a dry end wherein a sheet of wet stock that forms on a moving water permeable wire of a de-watering device that has a source of wet stock that is connected to a headbox through a first line having a first control valve that regulates flow through the first line and that has means for measuring the basis weight within the dry end, said system comprising:

means for measuring the basis weight within the dry end and generating first signals indicative of the dry end basis weight;

means for diverting a portion of wet stock flow from the source of wet stock through a second line having a second control valve that regulates flow through the second line and into the headbox;

a sensor positioned underneath and adjacent to the wire for measuring the basis weight of the wet stock and which generates second signals indicative of the wet end basis weight, said sensor being positioned upstream from a dry line which develops during operation of the system;

means for adjusting the flow rate through the first line in response to the first signals; and means for adjusting the flow rate through the second line in response to the second signals.

20. The system of claim 19 wherein the sensor comprises a plurality of individual sensor cells that are positioned at different locations in the direction of movement of the wire.

21. The system of claim 19 wherein the means for diverting a portion of the of the wet stock creates a flow rate through the second line that is less than about 25% by weight of the flow rate through the first line.

22. The system of claim 19 wherein the sensor includes a first electrode and a second electrode which is spaced-apart and adjacent to said first electrode, said wet stock being between and in close proximity to said first and said second electrodes, said sensor is coupled in series with an impedance element between an input signal and a reference potential; and wherein fluctuations in at least one of said properties of said wet stock causes changes in voltage measured across said sensor.

23. The system of claim 22 wherein said first electrode is coupled to said impedance element and said second electrode is coupled to said reference potential.

24. The system of claim 22 wherein said first electrode is coupled to said input signal and said second electrode is coupled to said impedance element.

25. The system of claims 23 further including a third electrode coupled to said reference potential, said first electrode being spaced-apart and residing between said second and said third electrodes, wherein another portion of said sheet of material is between and in close proximity to said first and said third electrodes.

26. The system of claim 22 further comprising means for providing a feedback signal to adjust said input signal such that said fluctuations in at least one of said properties are due to fluctuations in a single physical characteristic of said wet stock.

27. The system of claim 26 wherein said physical properties include dielectric constant, conductivity, and proximity of said portion of said wet stock to said sensor and said single physical characteristic of said wet stock comprises one of weight, chemical composition, and temperature.

28. The system of claim 22 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

29. The system of claim 28 wherein said sensor has an associated impedance and said associated frequency is adjusted such that said sensor impedance and said impedance of said one of said capacitive element and said inductive element are approximately equal.

30. A method of controlling the formation of a sheet of wet stock that forms on a moving water permeable wire of a de-watering machine, having a wet end and a dry end, that has a source of wet stock that is connected to a headbox through a first line having a first control valve that regulates flow through the first line and that has means for measuring the basis weight within the dry end, said method comprising the steps of:

(a) diverting a portion of wet stock flow from the source of wet stock through a second line having a second control valve that regulates flow through the second line;

(b) placing a sensor underneath and adjacent to the wire and upstream from a dry line which develops during operation of the machine;

(c) operating the machine and measuring the basis weight within the dry end and generating first signals indicative of the dry end basis weight and measuring the basis weight with the sensor and generating second signals indicative of the wet end basis weight;

(d) adjusting the flow rate through the first line in response to the first signals; and (e) adjusting the flow rate through the second line in response to the second signals.

31. The method of claim 30 wherein step (b) comprises placing a plurality of sensors at different locations in the direction of movement of the wire.

32. The method of claim 30 wherein the flow rate through the first line is at least about 70% of the combined flow rate through the first and second lines.

33. The method of claim 30 wherein each of said sensors includes a first electrode and a second electrode which is spaced-apart and adjacent to said first electrode, said wet stock being between and in close proximity to said first and said second electrodes, said each sensor is coupled in series with an impedance element between an input signal and a reference potential; and wherein fluctuations in at least one of said properties of said wet stock causes changes in voltage measured across said each sensor.

34. The method of claim 33 wherein said first electrode is coupled to said impedance element and said second electrode is coupled to said reference potential.

35. The method of claim 33 wherein said first electrode is coupled to said input signal and said second electrode is coupled to said impedance element.

36. The method of claim 34 further including a third electrode coupled to said reference potential, said first electrode being spaced-apart and residing between said second and said third electrodes, wherein another portion of said sheet of material is between and in close proximity to said first and said third electrodes.

37. The method of claim 33 further comprising means for providing a feedback signal to adjust said input signal such that said fluctuations in at least one of said properties are due to fluctuations in a single physical characteristic of said wet stock.

38. The method of claim 37 wherein said physical properties include dielectric constant, conductivity, and proximity of said portion of said wet stock to said each sensor and said single physical characteristic of said wet stock comprises one of weight, chemical composition, and temperature.

39. The method of claim 33 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

40. The method of claim 39 wherein said each sensor has an associated impedance and said associated frequency is adjusted such that said each sensor's impedance and said impedance of said one of said capacitive element and said inductive element are approximately equal.

* * * * *